US005884415A

United States Patent [19]

Sims et al.

[11] Patent Number: 5,884,415

[45] Date of Patent: Mar. 23, 1999

[54] PAPER MAKING MACHINE PROVIDING CURL CONTROL

[75] Inventors: Duke N. Sims, Roscoe, Ill.; Gregory L. Wedel, Beloit, Wis.

[73] Assignee: Beloit Technologies, Inc., Wilmington, Del.

[21] Appl. No.: 694,659

[22] Filed: Aug. 5, 1996

Related U.S. Application Data

[63] Continuation-in-part of Ser. No. 192,685, Feb. 7, 1994, Pat. No. 5,542,193, which is a continuation-in-part of Ser. No. 95,135, Jul. 21, 1993, Pat. No. 5,283,960, which is a continuation of Ser. No. 873,420, Apr. 24, 1992, Pat. No. 5,269,074.

[51] Int. Cl.[6] ..... F26B 11/02

[52] U.S. Cl. ..... 34/117; 34/445; 34/446

[58] Field of Search ..... 34/117, 445, 446, 34/454

[56] References Cited

U.S. PATENT DOCUMENTS

| | | | |
|---|---|---|---|
| 2,046,553 | 7/1936 | Edwards | 34/24 |
| 2,062,992 | 2/1936 | Wunsch | 34/48 |
| 2,537,129 | 1/1951 | Goodwillie | 92/49 |
| 2,714,342 | 8/1955 | Beachler | 92/53 |
| 2,929,450 | 3/1960 | Kurz | 162/379 |
| 2,959,222 | 11/1960 | Hornbostel | 162/360 |
| 3,079,699 | 3/1963 | Fry, Jr. | 34/13 |
| 3,110,612 | 11/1963 | Gottwald et al. | 117/64 |
| 3,134,653 | 5/1964 | Justus et al. | 34/114 |
| 3,263,344 | 8/1966 | Stickle | 34/116 |
| 3,395,073 | 7/1968 | Davis, Sr. | 162/369 |
| 3,416,237 | 12/1968 | Sutherland et al. | 34/23 |
| 3,564,724 | 2/1971 | Keyes, IV et al. | 34/48 |
| 3,658,642 | 4/1972 | Keyes, IV et al. | 162/197 |
| 3,833,466 | 9/1974 | McCarty | 162/142 |
| 3,868,780 | 3/1975 | Soininen et al. | 34/116 |
| 3,874,997 | 4/1975 | Kankaanpää | 162/290 |
| 3,925,906 | 12/1975 | Chance et al. | 34/18 |
| 3,939,034 | 2/1976 | Tanaka et al. | 156/522 |
| 4,000,035 | 12/1976 | Schiel et al. | 162/290 |
| 4,146,972 | 4/1979 | Smith, Jr. | 34/41 |
| 4,183,148 | 1/1980 | Koski et al. | 34/23 |
| 4,202,113 | 5/1980 | Kankaanpaa | 34/23 |
| 4,314,878 | 2/1982 | Lee | 162/198 |
| 4,359,827 | 11/1982 | Thomas | 34/16 |
| 4,359,828 | 11/1982 | Thomas | 34/114 |
| 4,441,263 | 4/1984 | Vedenpää | 34/115 |
| 4,481,723 | 11/1984 | Vedenpää | 34/114 |
| 4,483,083 | 11/1984 | Chance | 34/113 |
| 4,510,698 | 4/1985 | Ely | 34/117 |
| 4,539,762 | 9/1985 | Eskelinen et al. | 34/114 |
| 4,566,944 | 1/1986 | Mauranen et al. | 162/286 |
| 4,608,124 | 8/1986 | Mauranen et al. | 162/193 |
| 4,625,430 | 12/1986 | Aula et al. | 34/13 |
| 4,625,434 | 12/1986 | Karlsson et al. | 34/114 |
| 4,677,762 | 7/1987 | Futcher | 34/114 |
| 4,686,778 | 8/1987 | Kotitschke et al. | 34/117 |
| 4,744,156 | 5/1988 | Futcher | 34/114 |
| 4,881,327 | 11/1989 | Hauser et al. | 34/114 |
| 4,934,067 | 6/1990 | Wedel | 34/41 |
| 4,980,979 | 1/1991 | Wedel | 34/23 |
| 4,982,513 | 1/1991 | Loser et al. | 34/116 |
| 4,986,009 | 1/1991 | Haessner et al. | 34/23 |
| 4,989,079 | 1/1991 | Ito | 358/80 |
| 5,062,216 | 11/1991 | Hannigan | 34/16 |
| 5,101,577 | 4/1992 | Wedel | 34/114 |
| 5,232,554 | 8/1993 | Kotitschke | 162/193 |
| 5,269,074 | 12/1993 | Sims et al. | 34/117 |
| 5,283,960 | 2/1994 | Sims et al. | 34/117 |
| 5,291,666 | 3/1994 | Babinsky et al. | 34/18 |
| 5,377,428 | 1/1995 | Clark | 34/446 |
| 5,379,528 | 1/1995 | Oechsle | 34/446 |
| 5,542,193 | 8/1996 | Sims et al. | 34/117 |

FOREIGN PATENT DOCUMENTS

| | | |
|---|---|---|
| 305229 | of 1971 | Cocos (Keeling) Islands . |
| 1121341 | 10/1984 | Cocos (Keeling) Islands . |
| 426607A2 | 5/1991 | European Pat. Off. . |
| 345266B1 | 2/1993 | European Pat. Off. . |
| 726353A2 | 8/1996 | European Pat. Off. . |
| 2355397 | 6/1974 | Germany . |
| 2813933 | 10/1978 | Germany . |
| 3520070 | 12/1985 | Germany . |
| 3807857 | 9/1989 | Germany . |
| 9001209.7 | 5/1990 | Germany . |
| 4037661 | 12/1991 | Germany . |
| 63-89996 | 6/1988 | Japan . |
| 2173832 | 10/1986 | United Kingdom . |
| 8202937 | 9/1982 | WIPO . |
| 8300514 | 2/1983 | WIPO . |

8804206 6/1988 WIPO .
8806204 8/1988 WIPO .
8806205 8/1988 WIPO .

OTHER PUBLICATIONS

G.L. Wedel et al., *Advances in Dryer Section Runnability, TAPPI Journal*; Sep. 1987; pp. 65–69.
I. Binns; *Examining Runnability in the Dryer Section*; Jul., 1987; pp. 27–28.
*No. 16 Takes Shape*; Consolidated News, vol. 29, No. 4, Aug.–Oct. 1991; pp. 8–10.
T. Bal et al.; *Valmet's Sym–Run Concept: a New Tool for High–Speed Drying; Paper Age*; Nov. 1991; pp. 12–13.
E. Beuleke; *Trockenpartie*; 45. Jahrgang. heft 10A. 1991, *Innovations In The Area Of The Paper Machine. (3). Dryer Section.*
J. Pulkowski; *Operating Results with the Bel–Champ Single–Tier Dryer*; 1990 Engineering Conference, TAPPI.
G.J. Chalmers; *New dryer section developments*; Pulp & Paper, Feb. 1985, pp. 134–137, 139.
G.L. Wedel; *No–Draw Drying Restraint*; 1988 Engineering Conference, TAPPI Proceedings; pp. 275–281.
G.L. Wedel et al.; *Dryer Section Runnability*; 1987 Engineering Conference, TAPPI Proceedings; pp. 279–286.
S. Palazzolo; *No–Draw Drying*; TAPPI Notes; 1991, pp. 61–64.
Dr. R. Field; *Properties And Uniformity Improved By Single–tier Drying*; Paper Technology; Apr. 1991, pp. 36–39.
G.L. Wedel; *Drying Restraint in a Single–Tier Dryer Section*; 1989 Annual Meeting, TAPPI Proceedings; pp. 23–29.
N.P. Black; *Changes In Paper Technology Will Result In Major Changes In The Designs And Capabilities Of Paper Machines*; TAPPI Journal, Jan. 1991, pp. 69–72.
J.L. Chance; *Restrained Drying: Commercial Experience*; Paper Presented at 45th Annual General Conference Melbourne 1991.
H. Ilvespaa et al. *Single–Felted Drying Boosts Paper Machine Efficiency, Paper Quality* Pulp & Paper, Mar. 1991, pp. 134–136.
Heinback–Seminar; Jun. 10, 1989; J. Fischer; "Neue Elemente Bei Der Papiertrocknung"; (J.M. voith GmbH) translation—New Elements in Paper Drying.
J. Shands et al.; *Cross Machine Variation of Paper Curl on a Twin–Wire Machine*, TAPPI proceedings, 1988 Engineering Conference, Book 2, p. 283 et seq.
K. Przbysz and J. Czechowski; *Effect of Water Retention (WRV) on the Paper Web Drying Process*.
M. Htun et al.; *Relation Between Drying Stresses and Internal Stresses and the Mechanical Properties of Paper*, pp. 2–13.
Gunnar Gavelin; *Drying of Paper and Paperboard*, 1972, Table of Contents and Chapter 22, pp. 277–287.
Betriebs–Schwierigkeiten, Feb. 1965, Manfred Judt, pp. 112–113.
APV–Jahrestreffen 1973, Vortragsreihe, >> Trocknumg von Papier >>, von M. Staberock, pp. 55–61.
Paper given by Valmet at Apr. 1989 CPPA Printing Conference, untitled; pp. 1–14.
K. Ishiguro; "Recent Development in Papermaking (IX)"; Oct. 1988; pp. 40–46.
Voith, GmbH, and Voith, Inc. v. Beloit Corporation, Civ. Action No. 93C0905C, Prior Art Statement Pursuant To 35 USC § 282, Apr. 17, 1995, p. 5.
CPI # 16.
James Maclaren PM # 3 and SCA Ortviken PM #5—1 page.
Leykhem, Bruck, Austria, GD–133939–1–0–0.
Champion Int., Quinnesec PM #41, MA–A747–1–0–0.
Bear Island, PM#2, LF–133911–4–0–0.
Bear Island, PM#2, LF–133911–4–1–0.
Bear Island, PM#2, FL–133911–4–2–0.
S.D. Warren, PM#3, GD–134009–1–0–0.
Mead, Escanaba—LF–130400–4–2–0.
Newsprint South Grenada, PM#1, MA–A750–3–0–0.
Duluth PM#2, 1.12–16 176.
Union Camp, PM#2, 21.

*Primary Examiner*—Henry Bennett
*Assistant Examiner*—Pamela A. Wilson
*Attorney, Agent, or Firm*—McAndrews, Held & Malloy, Ltd.

[57] ABSTRACT

The invention is a paper making machine and a method of making paper. The machine includes a section for forming a wet paper web having first and second sides and a dryer for drying the wet paper web. At least a first portion of the dryer is capable of preferentially drying the first side of the wet paper web to a dryness level of at least about 70% solids. In a variation of the paper making machine, the first portion of the dryer is capable of preferentially drying the first side of the wet paper web to a dryness level of at least about M, as represented by the formula:

$$M=101-0.246\ (WRV)$$

in which WRV is the water retention value of the web. The method for drying a web of paper includes a forming step and a drying step. The forming step is carried out by forming a wet paper web having first and second sides. The drying step is carried out, at least in part, by preferentially drying the first side of the wet paper web to a dryness level of at least about 70% solids, or alternatively a dryness level of "M" as defined previously. After this preferential drying step, various apparatus and steps can be employed to inhibit curl.

39 Claims, 11 Drawing Sheets

PAPER MAKING MACHINE PROVIDING CURL CONTROL

CROSS-REFERENCE TO RELATED APPLICATIONS

The present application is a continuation-in-part of U.S. Ser. No. 08/192,685, filed Feb. 7, 1994, now U.S. Pat. No. 5,542,193; which is a continuation-in-part of U.S. Ser. No. 08/095,135, filed Jul. 21, 1993, now U.S. Pat. No. 5,283,960; which is a continuation of U.S. Ser. No. 07/873,420, filed Apr. 24, 1992, now U.S. Pat. No. 5,269,074. Each of the foregoing applications and resulting patents is hereby incorporated by reference herein in its entirety to provide continuity of disclosure.

TECHNICAL FIELD

The present invention relates to a paper making machine for making and drying a web of paper. More particularly, the present invention relates to a dryer for a paper making machine so arranged as to preferentially dry one side of the web to a relatively high dryness, and then preferably inhibit (i.e. reduce or eliminate) curl in a web which otherwise would curl when it is dry.

BACKGROUND OF THE INVENTION

In the manufacture of lightweight paper grades, such as tissue, newsprint and fine paper, a continuous web or strip of paper is formed and in some cases pressed in the wet end of the machine, then dried on a series of steam-heated drying cylinders. The wet web is pressed directly onto at least some of the cylinders by tensioned, permeable fabrics or felts.

A conventional double-felted, two tier dryer group is shown in FIG. 1. The two tier, double felted dryer group, generally designated 10, includes internally steam-heated dryer cylinders 12, 14 and 16 arranged as an upper tier, generally designated 18, and similar dryer cylinders 20, 22 and 24 arranged as a lower tier, generally designated 26.

The rolls 30 and 32 are located closely adjacent to and between adjacent dryer cylinders of the upper tier 18. The rolls 34 and 36 are located closely adjacent to and between adjacent dryer cylinders of the lower tier 26.

In the double-felted, two tier dryer group of FIG. 1, the wet paper web shown as a dashed line W is threaded and travels around the bottom of one dryer cylinder such as 20 in the bottom tier 26 of dryers, where the top of the web W is dried; then around the top of one dryer cylinder such as 12 in the top tier 18 of dryer cylinders, where the bottom of the web W is dried; then around the next dryer cylinder 22 in the bottom tier 26 of dryer cylinders; and so forth in a generally serpentine or up and down fashion. The directions of rotation of the dryer cylinders in FIG. 1 dictate that the web W is working its way from left to right in that machine.

The portions of the web W passing between the upper and lower tiers 18 and 26 of dryer cylinders form long, unsupported "open draws" as shown at the points 40, 42, 44, 46 and 48. The majority of the water vapor that leaves the sheet or web is released in these open draws. As it passes through the double-felted, two tier dryer group, the web W is dried alternately on each side. This two-sided drying tends to inhibit curl.

Problems have been experienced during operation of conventional double-felted, two tier dryer groups. For example, the sheet or web flutters as it moves through the open draws. This problem particularly occurs in the "wet end" of the dryer, where the web is still quite wet. A fluttering web frequently breaks on the machine. A web break is expensive and time-consuming to correct. Even an occasional web break is a very big problem. It can damage the felt and even the machine, and it inevitably causes production of paper to stop until any necessary repairs can be made and the web can be re-threaded in the running machine.

While a web break is being corrected, a web of undried paper as wide as the machine (often about 30 feet or nine meters wide) and miles (several km.) long is formed and must be collected, broken up, mixed with a much larger quantity of water, and recycled in the paper machine. The web must then be re-threaded in the machine while it is running.

Machine speeds, and thus the amount of paper a machine could produce, were limited by the need to avoid an excessive number of web breaks by keeping the web speed low enough to minimize its flutter in open draws. Even after taking this precaution, web breaks were a common occurrence.

Also, in conventional double-felted, two tier dryer groups, problems are caused by cross-directional sheet shrinkage and inefficient ventilation of evaporated water. Additionally, conventional double felted two tier dryer groups typically require threading ropes in order to thread a tail of the web.

Some of the problems with sheet flutter, sheet shrinkage, and vapor ventilation have been solved by using one or more top-felted single tier dryer groups in the wet end of the dryer.

Top-felted single tier dryer groups are arranged much like the top tier 18 of dryers, rolls 30 and 32, and top felt of FIG. 1. The primary difference is in how the web is threaded through the dryer group. Instead of going back and forth between two tiers of dryer cylinders, in a single tier dryer group the web and supporting felt follow the same path throughout the group. The web W and felt are wound together about one dryer cylinder with the paper web facing the dryer cylinder and the felt on the outside, then around a counter roll (typically a vacuum cylinder or other arrangement to keep the web on the felt) with the felt facing the counter roll and the paper on the outside, then to the next drying cylinder in sequence. The same side of the web contacts each dryer in the single tier group.

For example, in the top-felted single tier arrangement of FIG. 4, the dryer felt, with the web beneath it and following the same path, winds over the dryer cylinder 81, under the vacuum roll 88, over the dryer cylinder 82, under the vacuum roll 89, over the dryer cylinder 83, under the vacuum roll 90, over the dryer cylinder 84, under the vacuum roll 91, over the dryer cylinder 85, under the vacuum roll 92, and over the dryer cylinder 86. Each cylinder 81–86 directly contacts and thus preferentially dries only the bottom of the web.

Dryers as shown in FIG. 2 including one or more top-felted single tier dryer groups 60, 62, and 64, followed by two or more two-tier double-felted dryer groups 65, 66, and 67 at the dry end, like the one shown in FIG. 2, have been sold by Beloit Corporation under the trademark "BEL-RUN". Each top-felted single tier dryer in the groups 60, 62, and 64 only directly contacts one side of the web —specifically, the bottom side—with the heated surfaces of the drying cylinders.

It is well known that the sheet tends to curl toward the last side of the web to be dried, at least in laboratory studies. Therefore, a dryer consisting entirely of top-felted groups such as 60–64 would directly dry only one side throughout, and would severely curl the paper toward that side. Those skilled in the art have believed that preferentially drying the web on one side for very long without periodically compensating by drying directly on the other side would create an imbalance in drying on the respective sides of the web, leading to a problem with sheet curl.

In the dryers represented by FIG. 2, this problem was addressed by limiting the series of top-felted single tier groups to the wet end of the machine, and following the single tier dryer groups with double tier groups 65–67 which reverse the sheet with each succeeding dryer cylinder and thus avoid curl. A typical dryer including single tier sections had approximately 40 percent of the dryer cylinders in top-felted single tier groups, and the remaining dryer cylinders are two tier, double felted dryer cylinders. In FIG. 2, 14 of the 36 dryer cylinders—39%—are in the single tier groups 60–64, and 61% of the dryer cylinders are in the two-tier groups 65–67.

Subsequently, the dryer illustrated in FIG. 3 was developed, consisting entirely of single tier sections. The problem of one sided drying was addressed in these all-single-tier machines by providing alternating top-felted groups (60B, 72, and 76) and bottom-felted or inverted groups (70, 74). Such dryers have been sold, for example, under the trademark "BEL-CHAMP" by Beloit Corporation.

In this arrangement, a top-felted group like 60B preferentially dries the bottom of the web and a bottom-felted group like 70 preferentially dries the top of the web. Thus, any one single tier dryer group preferentially dries just one side of the web.

Concern about sheet curl led paper dryer builders to dry alternate sides even in the very early stages in the alternating single tier dryers. For example, the #3 machine at CTS, Duino, Italy, was designed with the first three dryer cylinders top felted, the next three bottom felted, and the following three top felted. These first three groups were made small to ensure alternate-sided drying would be started in the very early stages of the drying process.

According to conventional thinking, therefore, the sheet must be reversed periodically by contacting it alternately with top-felted and bottom-felted dryer cylinders or groups to avoid curl by frequently reversing the side of the web being dried.

Top-felted single tier dryer groups are preferred over bottom-felted single tier dryer groups, particularly in the wet end of the machine. Although web breaks are infrequent in single tier groups, when the web does break, if it then wraps around a bottom felted dryer cylinder, the wrapped paper cannot be easily dumped into the basement, as the felt underlies the web throughout the group. (The "basement" of a paper machine is the open space beneath the machine. The "broke" or displaced, partially made paper produced by the machine is collected in the basement for recycling.) Rather, the broke must be manually removed from the bottom felted dryer group by a worker. The manual removal of broke is time-consuming, and often must be done while the machine is stopped.

Top-felted groups are open beneath the web, as the felt is above the web in such a group, so broke automatically goes into the basement when the web breaks, or can be easily diverted there.

Thus, adding bottom-felted single tier groups like 70 and 74 in FIG. 3 to avoid curl has caused other problems in alternating single tier arrangements.

Another difficulty with the entirely single tier dryer is that none of its dryer cylinders are stacked vertically by providing upper and lower tiers of dryers. Conventionally, the successive dryer cylinders are in a generally horizontal arrangement rather than in a two tier arrangement. Thus, the machine commonly is longer than earlier machines which have the same number and size of dryer cylinders. This all single tier arrangement can have the disadvantage of requiring more interior floor space than a double tier dryer group, even though each dryer cylinder of a single tier arrangement commonly has a higher drying capacity than one dryer cylinder of a two tier arrangement.

The alternating single tier figuration also commonly requires two vacuum rolls at each of the transfers from the last dryer of one dryer group to the first dryer of another group, compared to an all-top-felted single tier arrangement which requires just one vacuum roll near the transfer or a double-felted two-tier group which may require none.

SUMMARY OF THE INVENTION

One object of the invention is thus to provide more consecutive top-felted single tier dryer cylinders or groups in a dryer, preferably without causing the web to curl after it is dried.

Another object of the invention is to correct the curl caused by preferentially drying the web on one side.

Still another object of the invention is to reduce the number of bottom-felted dryer groups, particularly in single tier sections.

These and other objects are met, at least to a degree, by the present invention.

One aspect of the invention is a paper making machine. The machine includes a section for forming a wet paper web having first and second sides. The machine also includes a dryer for drying the wet paper web. At least a first portion of the dryer is capable of preferentially drying the first side of the wet paper web to a dryness level of at least about 70% solids.

In a variation of the paper making machine, the first portion of the dryer is capable of preferentially drying the first side of the wet paper web to a dryness level of at least about "M," as represented by the formula:

$$M=101-0.246\ (WRV)$$

in which "M" is the dryness of the web (critical moisture content, expressed in % solids by weight) and "WRV" is the water retention value of the web, measured by the Zell Chemung standard used in the Przybysz reference discussed below. As that standard specifies, water retention value is expressed as a percentage for the above formula.

Another aspect of the invention is a method for drying a web of paper. The method includes a forming step and a drying step. The forming step is carried out by forming a wet paper web having first and second sides. The drying step is carried out, at least in part, by preferentially drying the first side of the wet paper web to a dryness level of at least about 70% solids.

In a variation of the method, the preferential drying step is carried out to a dryness level of at least about "M," as defined in the water retention value formula above.

The present inventors have made the surprising discovery that the web can be preferentially dried on one side, as by a series of consecutive top-felted single tier dryers, to a higher dryness level than was previously believed possible, such as 70% or greater dryness or a dryness of "M" as previously defined, without imparting curl to the fully dried web. The curl which normally would be created by this one-sided drying, previously thought to be difficult or impossible to effectively reverse, can be reversed. Many expedients for reversing curl are available in this situation, as will become apparent from the present description.

The invention has several advantages. The predominant top-felted dryers allow ready access to the dryer cylinders for operation and maintenance of the machine. Broke handling and removal from all of the top felted groups is done in a downward direction, thus eliminating the need for extensive scaffolding, operator platforms and conveyors which would be required for efficient access around bottom felted groups. The dryer groups can be arranged horizontally, with all the group-to-group transfers located for direct access from the main operating floor. These transfers include the press-to-dryer transfer (from the press 58, partially shown in FIG. 2, to the first dryer group 60) at the wet end of the dryer, the dryer group to dryer group transfers within the dryer, and the dryer-to-calender transfer at the dry end of the dryer. (The calender such as 68 in FIG. 2 is not generally regarded as part of the dryer; it forms a desired finish on the surfaces of the paper.)

Most of the machine can be threaded without threading ropes, and efficient curl control is possible. Additionally, the arrangement of the present invention can reduce the overall length of the paper machine, compared to an alternating single tier dryer, because some of the dryer cylinders can be stacked in at least one two tier group. The single tier part of the dryer achieves high average felt wrap angles on the dryer cylinders for improved drying rates, improved drivability and improved sheet restraint.

Furthermore, the proposed dryer group provides enhanced two-sided drying for improved curl control, as the last dryer cylinders in the two-tier dryer group can be used for curl control. The last dryer cylinders have been found to be the most effective in terms of curl control.

The inventors have discovered that the single tier dryer groups, according to the present invention, are effective in reducing cross-directional shrinkage in the wet end of the dryer group. However, it has been further discovered that single-tier dryer groups have less effect in the last dry end group.

Comparative test results from trials indicate that for a BEL-CHAMP dryer group, the cross-directional shrinkage is nearly zero until the web dryness reaches a level of about 65 to 80 percent dry. After this point in a single tier group, the cross-machine direction (CD) shrinkage increases, although at a rate that is less than the shrinkage rate of a web dried with a conventional double felted, two tier dryer group. Shrinkage occurs even though alternating single tier dryer groups are utilized. For this reason, only slightly more shrinkage will occur if the last dryer group is arranged in a two tier configuration.

Furthermore, the two tier group provides an open draw where a tail cutting mechanism can be located. At the same time, the dryer cylinders in the two tier group are arranged with the felt rolls offset so as to reduce the length of the open draws in order to maintain sheet stability and to direct the tail into the next felt/dryer cylinder nip in order to thread the tail without the need for threading ropes.

Definitions

The terms "upstream" and "downstream" are directions along the running web of paper, which is considered to travel, like a river, from upstream to downstream. The upstream portion of the paper making machine is capable of forming a wet web of paper. The downstream end of the paper making machine is where the paper leaves the paper making machine in the form of substantially dry paper. "Substantially dry paper" means paper having less than about 10% water content. The downstream end of the paper making machine can be downstream of any size press, on-machine coating equipment, or other apparatus on the machine which increases the water content of the running web before, during, or after the drying step.

"Preferentially drying" means drying one side of the web more than the other, such as by always or predominantly providing direct contact with heated dryer cylinders on one side of the web or by contacting one side of the web with hotter dryer cylinders than the other side of the web is exposed to.

The term "following" used to identify the relative positions of two machine elements, particularly the apparatus for preferentially drying the first side of the web in relation to curl control apparatus, refers either to one element directly following the other (i.e. without any intervening structure) or remotely following the other (i.e. with any amount of on-machine intervening structure).

"Latent curl" is defined herein as the condition in the undried web which can later cause the dry web to curl unless measures are taken to reverse it. Preferential drying to a certain dryness, unequal application or take-up of sizing on the respective sides of the web, and other factors can produce or contribute to latent curl. The minimum dryness of the web at which preferential drying will cause curl depends on the type of furnish used, the type of the machine used, operating conditions, and other factors.

DETAILED DESCRIPTION OF THE INVENTION

Figure 1:
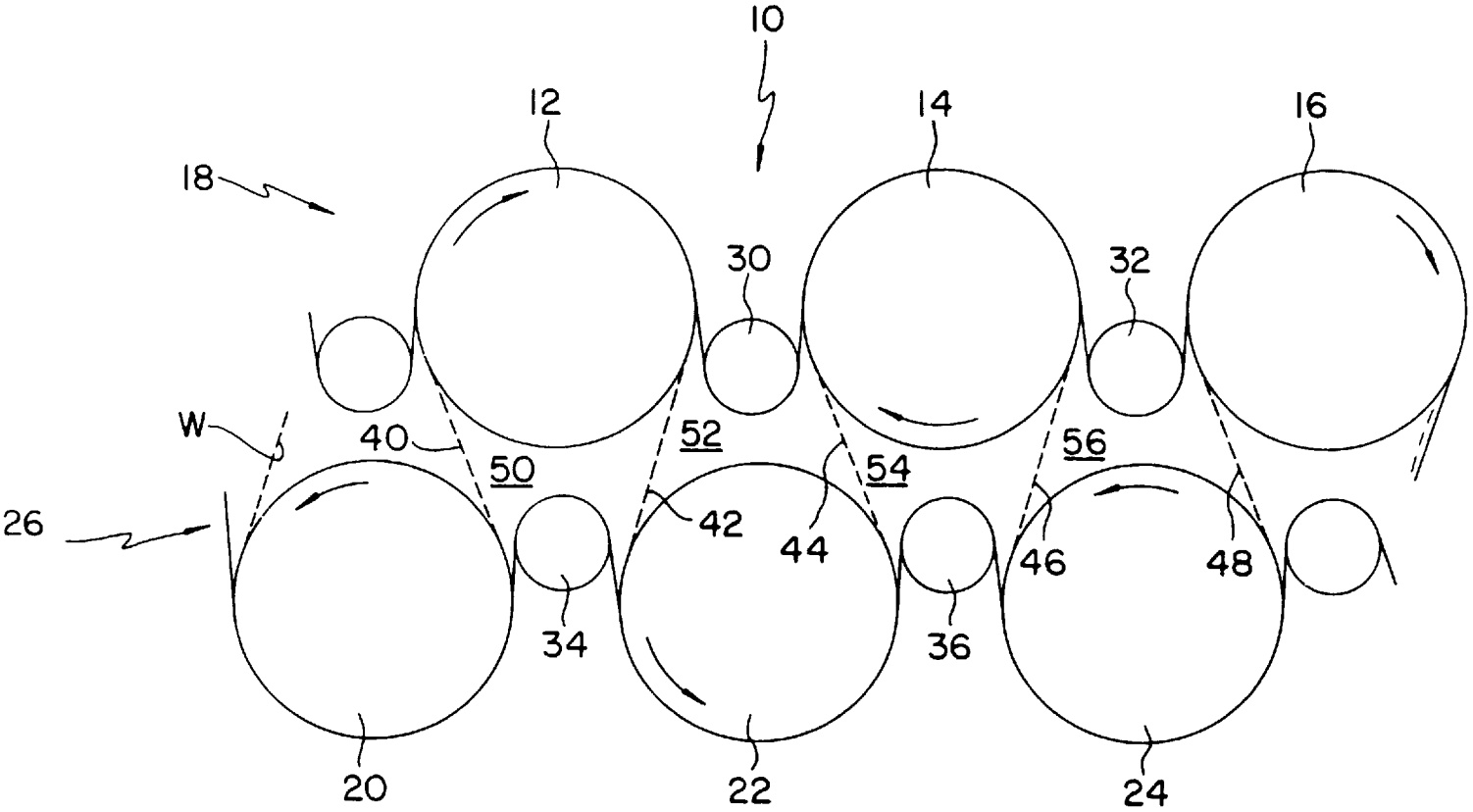
FIG. 1 PRIOR ART
FIG. 1 is a side elevational view of a prior art two tier, double felted dryer group.

This invention is illustrated by a description and drawings of a limited number of embodiments. Many other modifications and variations of the present invention will be readily apparent, however, to those skilled in the art after consideration of the detailed description and drawings presented here.

The scope of this patent is not limited to the preferred or specifically illustrated embodiments described in this specification. To the contrary, all modifications which are within the scope of any single claim at the end of this specification are protected by this patent. Each individual claim legally defines a patented invention.

Similar reference characters refer to similar parts throughout the various views of the drawings.

Figure 2:
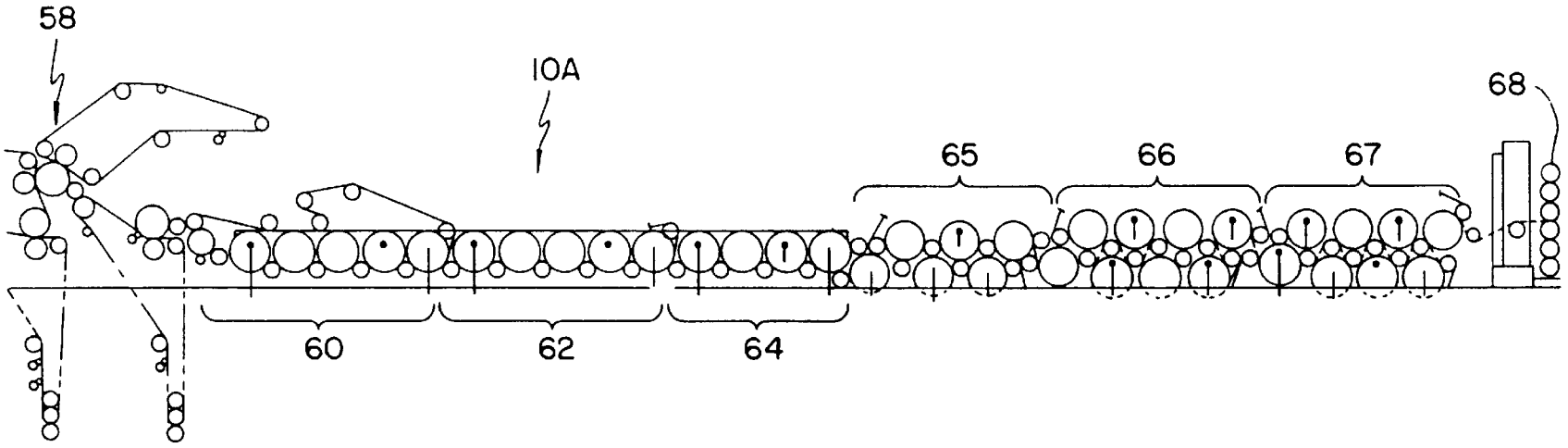
FIG. 2 PRIOR ART
FIG. 2 is a similar view of a prior art dryer which includes more than one top felted, single tier dryer group followed by more than one double felted, two tier dryer group.
Figure 3:
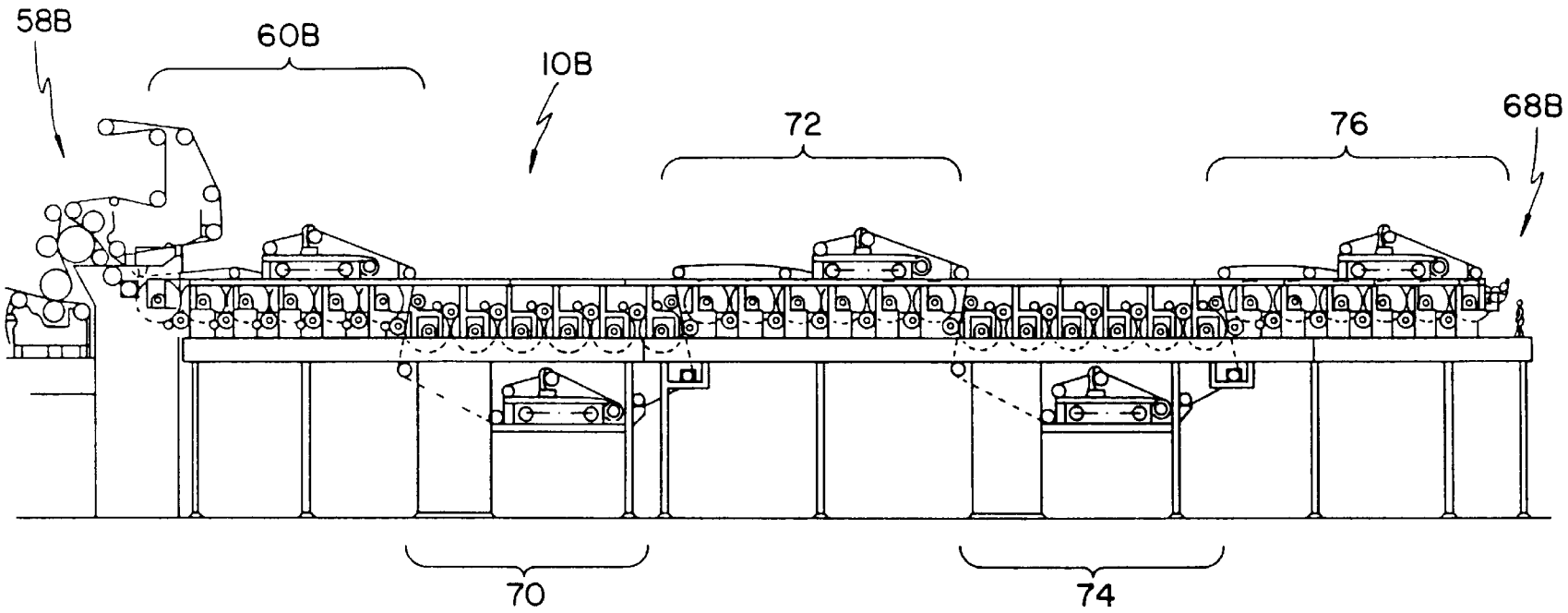
FIG.3 PRIOR ART
FIG. 3 is a similar view of a prior art BEL-CHAMP dryer including alternate top and bottom felted dryer groups for drying alternate sides of the web.

FIGS. 1–3 illustrating the prior art have already been described. Further discussion of these Figures can be found in U.S. Pat. No. 5,542,193, as previously incorporated by reference.

Figure 4:
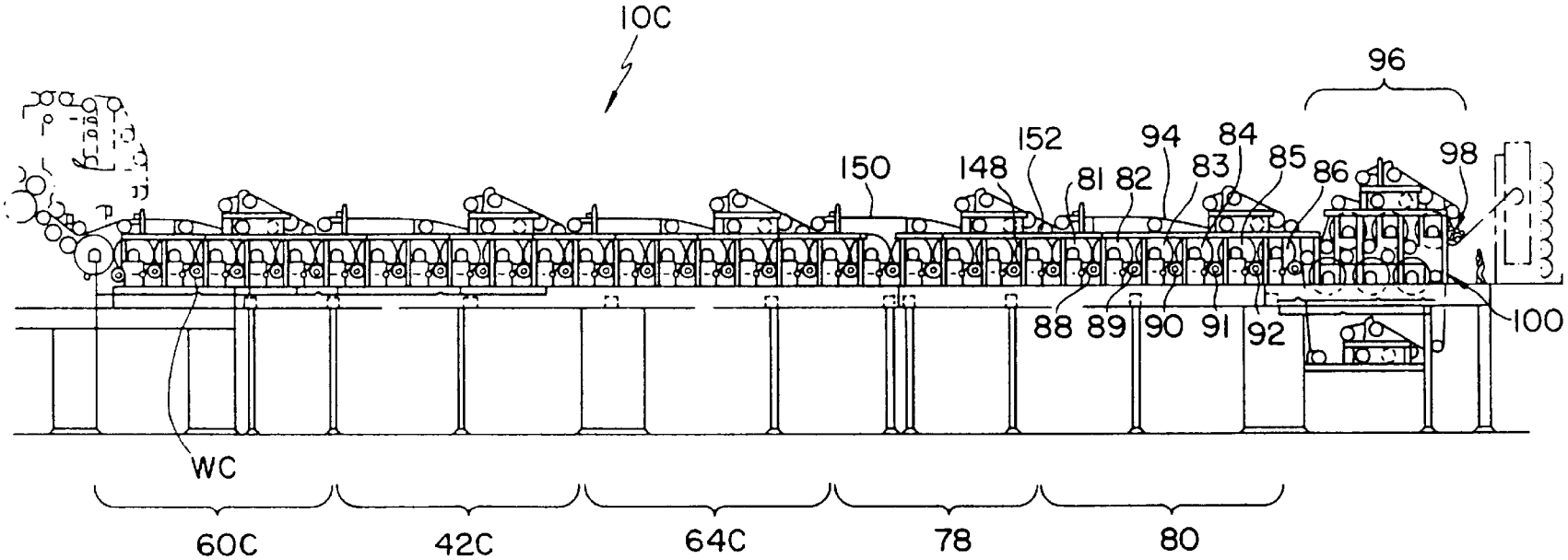
FIG. 4 is a similar view of the drying apparatus according to the present invention showing more than one top felted, single tier dryer group followed by a single, double-felted dryer group which can be regulated for controlling curl.
Figure 5:
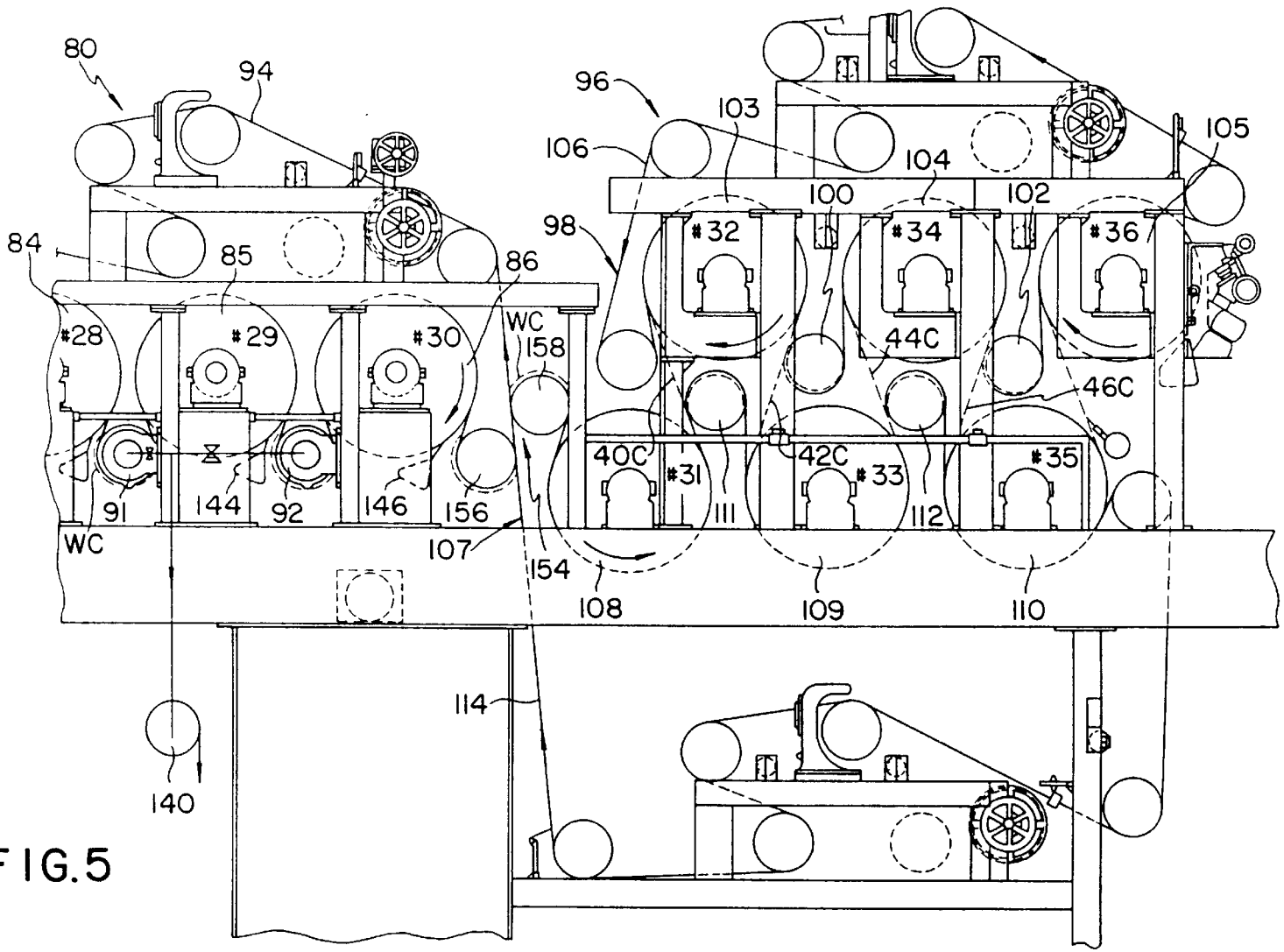
FIG. 5 is an enlarged, more detailed, partial view of FIG. 4 showing the transfer of the web WC from the last top felted single tier dryer group 80 to a solitary double-felted two tier dryer group 96.

FIGS. 4 and 5 are side-elevational views of a drying apparatus, generally designated 10C, made according to the present invention, for drying a web of paper WC. The apparatus 10C includes more than one dryer group, specifically the single tier groups 60C, 62C, 64C, 78, and 80 and the two tier group 96, for drying the web WC.

Each of the dryer groups 60C, 62C, 64C, 78 and 80 includes more than one dryer cylinder. For example, the dryer group 80 includes the dryer cylinders 81, 82, 83, 84, 85 and 86 which are in a single tier configuration. The last half of this dryer group 80 is best seen in FIG. 5.

Also, more than one vacuum roll, specifically the rolls 88, 89, 90, 91 and 92, is arranged so each vacuum roll 88 to 92 is located between adjacent members of the dryer cylinders 81 to 86.

A dryer felt 94 extends alternately around each dryer cylinder 81 to 86 and each vacuum roll 88 to 92. Each of the dryer cylinders 81 to 86 is top felted so that broke removal is facilitated.

Each of the top felted, single tier dryer groups 60C, 62C, 64C, 78 and 80 is arranged in succession and preferably, but not necessarily, without any open draw between successive dryer groups. The web WC is restrained against cross-machine and machine directional shrinkage during passage of the web WC through the dryer groups 60C, 62C, 64C, 78 and 80.

A last dryer group, generally designated 96, is located downstream relative to the plurality of dryer groups 60C, 62C, 64C, 78 and 80 so the web WC is transferred, preferably but not necessarily without an open draw, between the second-last dryer group 80 and the last dryer group 96. FIG. 5 is an enlarged view of the transfer to the last dryer group 96.

The last dryer group 96 includes an upper tier of dryer cylinders, generally designated 98, and an upper plurality of rolls 100 and 102 located between adjacent dryer cylinders 103, 104 and 104, 105 of the upper tier 98. An upper felt 106 extends alternately around each dryer cylinder 103 to 105 of the upper tier 98 and each roll 100 to 102 of the upper plurality of rolls.

The last dryer group 96 also includes a lower tier 107 of dryer cylinders 108, 109 and 110 and a lower plurality of rolls 111, 112 which are located between adjacent dryer cylinders 108, 109 and 110 of the lower tier 107. A lower felt 114 extends alternately around each dryer cylinder 108 to 110 of the lower tier 107 and each roll 111 to 112 of the lower rolls.

The web WC extends in open draws 40C, 42C, 44C and 46C between each dryer cylinder of the upper and lower tiers 98 and 107, respectively, and any tendency of the web WC to curl (also referred to in this specification as "latent curl" or simply "curl") is controlled (in other words, reduced or eliminated) during movement of the web WC through the last dryer group 96.

As shown in FIG. 4, the plurality of dryer groups includes five dryer groups 60C, 62C, 64C, 78 and 80, arranged in a substantially horizontal line. Minor deviations of individual dryer cylinders or tiers of cylinders from a strictly horizontal orientation are contemplated without departing from the invention, which most broadly does not require a horizontal orientation.

As shown in FIG. 5, the plurality of vacuum rolls 91 to 92 are each connected to a source of partial vacuum 140 so, during movement of the web WC around each of the vacuum rolls 91 to 92, the web WC is held against cross-machine and machine directional shrinkage. This occurs because the dryer felt 94 is located between the web WC and each of the vacuum rolls 91 and 92.

As shown in FIG. 5, each of the dryer groups, for example 80, further includes doctors such as 144 and 146 which cooperate with each dryer cylinder 84 to 86 of the plurality of dryer cylinders for assisting in the downward removal of broke.

The web WC, as shown in FIGS. 4 and 5, is transferred from one dryer group, for example 78, to a succeeding group, for example 80, without open draw.

More specifically, this transfer without open draw is accomplished by a lick-down transfer, which is well-known in the art. The transfer is carried out by supporting the web WC on the heated surface of a drying cylinder 148 (FIG. 4), a dryer felt 150 having been guided away from the drying cylinder 148 by a felt roll 152. The succeeding dryer felt 94 is guided into contact with the web WC supported by the drying cylinder 148 so the web WC is transferred to the succeeding felt 94, as is well-known in the art.

The web WC extends preferably without an open draw between the plurality of dryer groups 60C, 62C, 64C, 78 and 80 and the last dryer group 96 when the web has attained a dryness of at least about 70 percent, alternatively at least about 75 percent, alternately at least about 80 percent.

FIG. 5 shows a transfer, generally designated 154, between the plurality of drying groups 60C, 62C, 64C, 78 and 80 and the last dryer group 96.

More specifically, as shown in FIG. 5, the dryer group 80 also includes a downstream vacuum roll 156. The last dryer group 96 also includes an upstream vacuum roll 158 which is located adjacent to and downstream relative to the downstream vacuum roll 156. The web WC is sandwiched between the dryer felt 94 of the plurality of dryer groups and the lower felt 114 so the web WC is transferred from the dryer felt 94 to the lower felt 114 without open draw.

Figure 6:
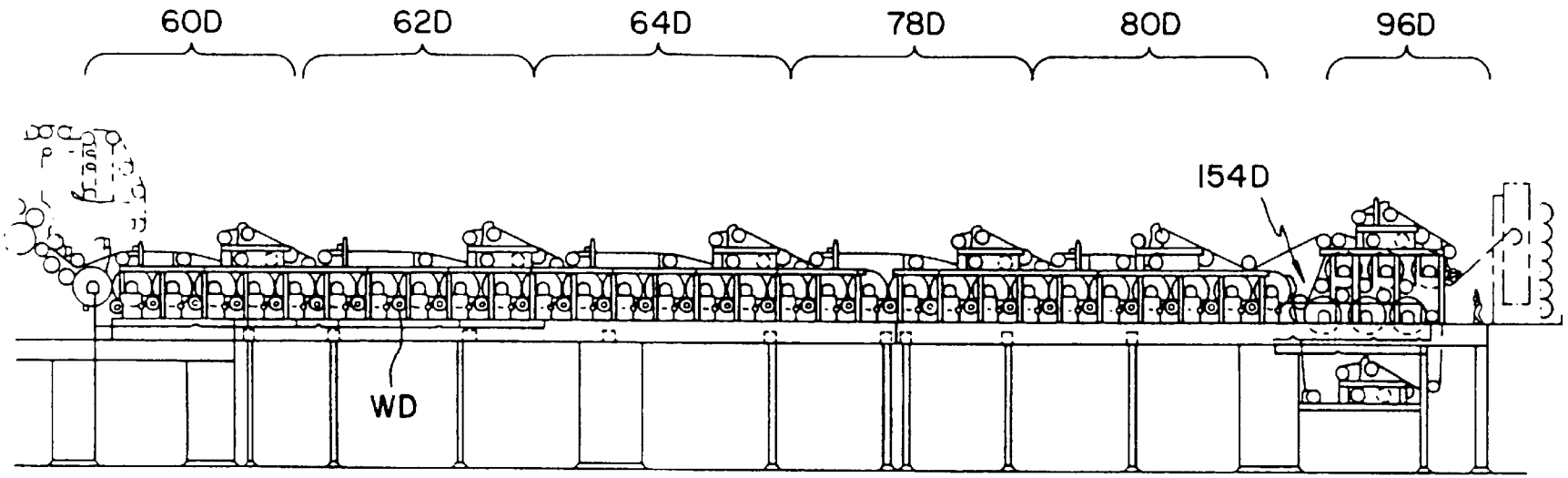
FIG. 6 is a similar view to that shown in FIG. 4 but shows an alternative embodiment of the present invention having another arrangement for transferring the web from the last single felted group 80D to the double felted group 96D, using blow boxes.

FIG. 6 is a side-elevational view showing an alternative transfer arrangement, generally designated 154D, for transferring a web WD from a first dryer section including more than one dryer group 60D, 62D, 64D, 78D and 80D to a second dryer section including at least one dryer group 96D.

Figure 7:
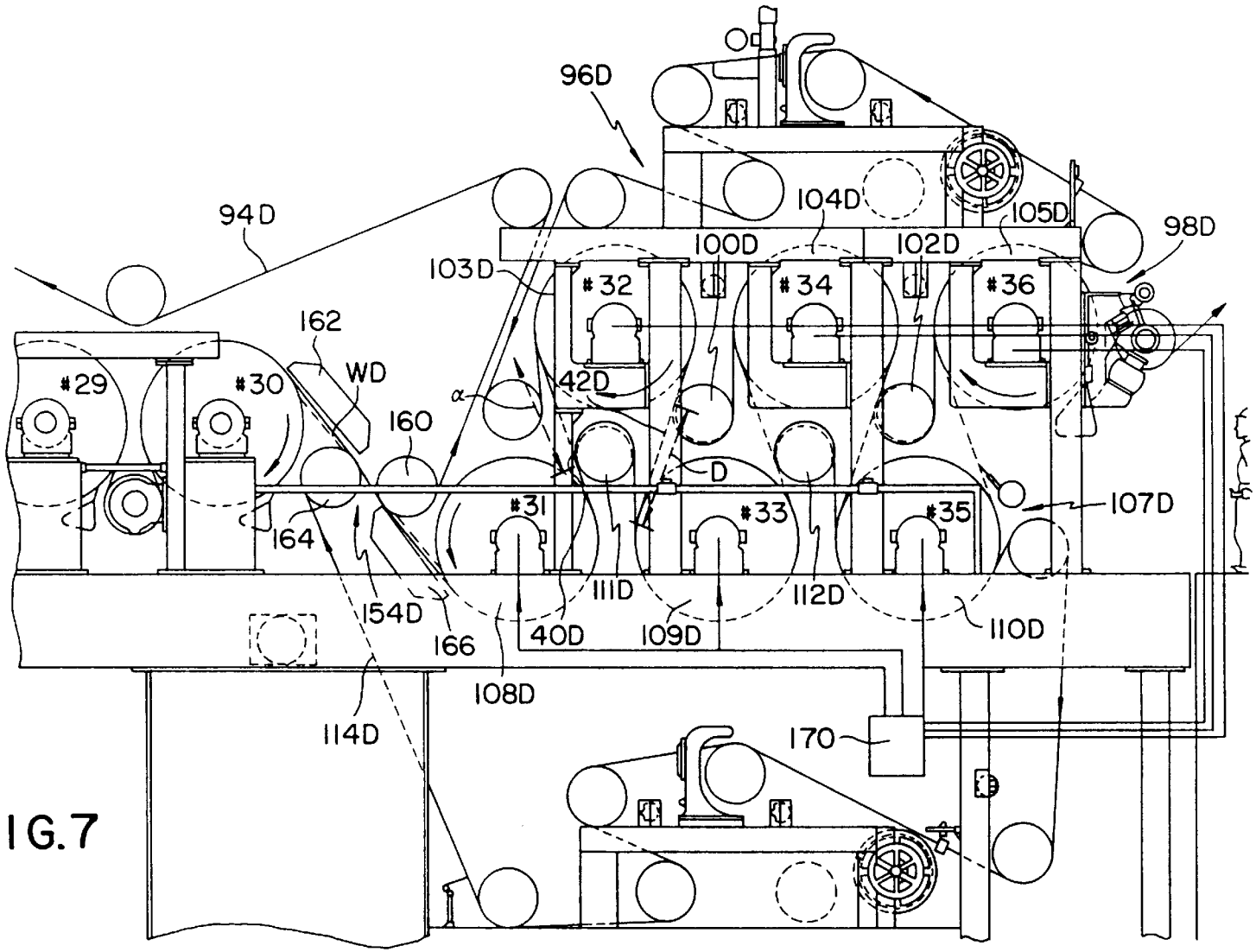
FIG. 7 is an enlarged view of the transfer arrangement shown in FIG. 6.

FIG. 7 is an enlarged view of the transfer 154D shown in FIG. 6 and includes a downstream felt roll 160 and a blow box 162 located adjacent to a dryer felt 94D and immediately upstream relative to the felt roll 160. The last single dryer group 96D also includes an upstream felt roll 164 located closely adjacent to the dryer felt 94D and upstream relative to the downstream felt roll 160.

A further blow box 166 is located closely adjacent to and downstream relative to the downstream felt roll 160 so the web WD is sandwiched between the dryer felt 94D and a lower felt 114D. The web WD is transferred without open draw from the dryer felt 94D to the lower felt 114D.

As shown in FIG. 7, at least some rolls 100D and 102D of the upper plurality of rolls are offset towards the adjacent upstream dryer cylinders 103D and 104D, respectively, of an upper tier 98D of dryer cylinders for reducing a distance D of the open draw 42D between each dryer cylinder 103D and 109D of the upper and lower tiers 98D and 107D, respectively.

Additionally, each roll 111D and 112D of the lower plurality or rolls is offset towards an adjacent upstream dryer cylinder 108D and 109D of the lower tier 107D of dryer cylinders so the open draw 40D between each dryer cylinder 108D and 103D of the lower and upper tiers 107D and 98D, respectively, is minimized, as indicated by the distance "d".

The dryers of FIGS. 4–7 can have various apparatus for controlling curl. One embodiment of curl control apparatus is a double-felted two tier dryer group at or near the dry end of the machine. Merely running the web through a double-felted two tier dryer group, which dries the top and bottom of the web alternately with each change of dryer cylinders, will control curl to some degree and may be sufficient to control curl to a desired degree.

As shown in FIG. 7, the last dryer group 96D also includes control means 170 for controlling the steam pressure within each dryer cylinder 103D, 104D and 105D of the upper tier 98D and each dryer cylinder 108D, 109D and 110D of the lower tier 107D of dryer cylinders, which in turn controls the amount of heat transferred from the respective dryer cylinders to the web. Any latent tendency of the web WD to curl due to preferential drying of one side is compensated for by the application of differential steam pressure between at least one pair of consecutive top and bottom dryer cylinders, resulting in sufficient preferential drying of the other side of the web to at least reduce, and preferably reduce to an acceptable level or substantially eliminate, the latent curl.

The necessary curl control apparatus can be as simple as the shut-off valves, typically ball valves, of each individual dryer cylinder. Some of the dryers can have their steam supply partially or completely shut off to regulate the relative drying capacity of the upper and lower tiers of dryers.

In an alternative arrangement, special pressure regulating valves can be provided for individual dryers or groups of dryers to control steam pressure. Other control schemes include regulating the amount of condensate in the respective cylinders so their heat transfer rates to the web are different, heating or cooling the web by other means than controlling steam pressure (as by applying heating or cooling air caps) to change the temperature of the web or of certain dryer cylinders, and so forth. At a minimum, the control means comprises at least one valve capable of being operated to individually change the steam pressure delivered to at least one dryer cylinder. The valves may be operated manually, remotely, or automatically, and may be operated individually or in groups according to a variety of control schemes.

Figure 8:
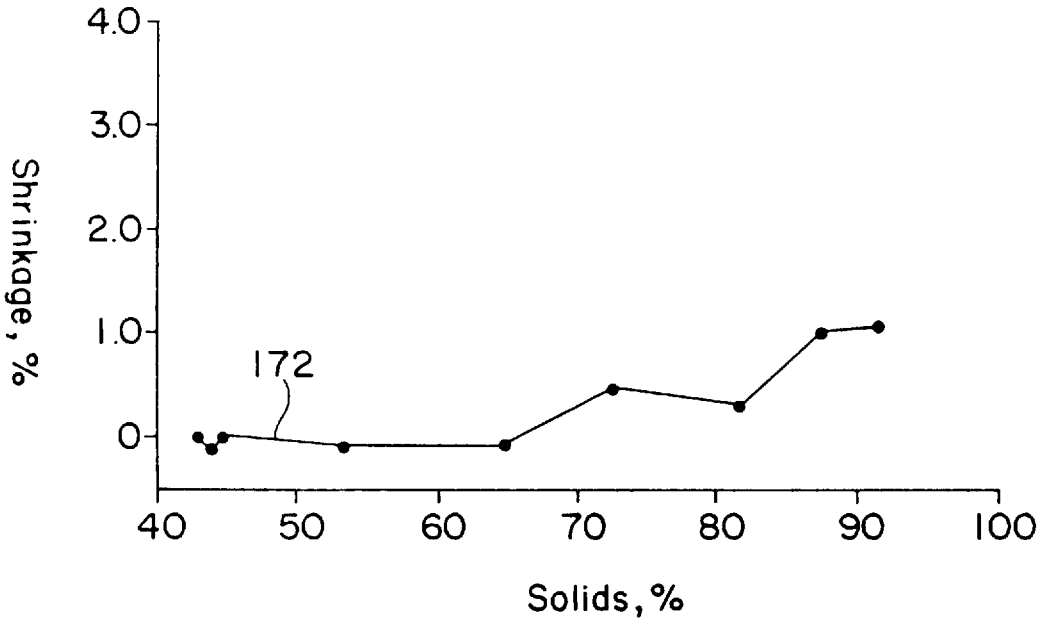
FIG. 8 is a graph generated from the results of trials showing the percentage of solids within the dried web relative to the percentage of shrinkage in a cross-machine direction of the web.
Figure 9:
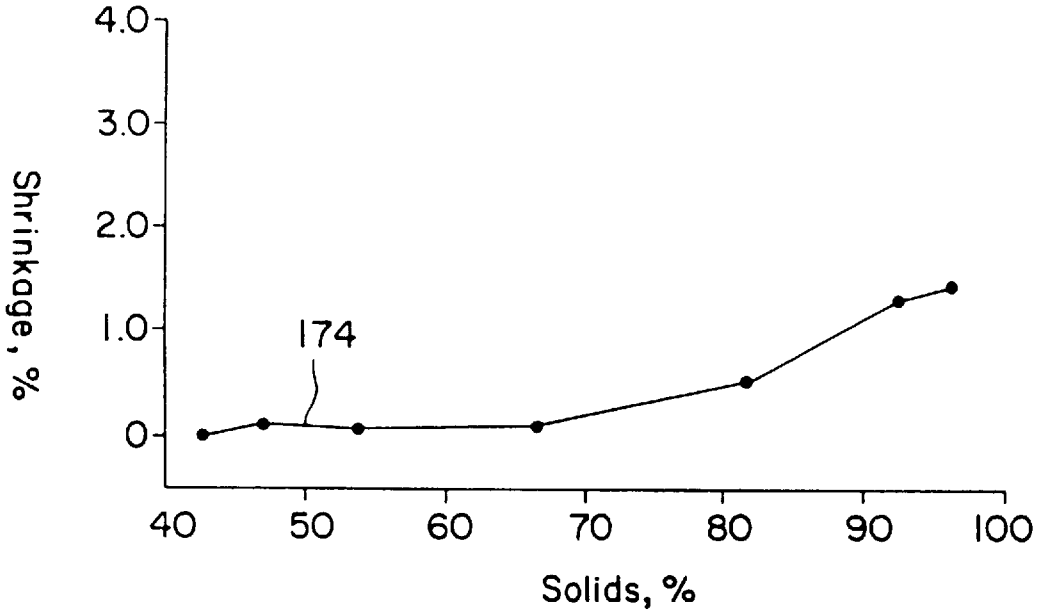
FIG. 9 is a graph similar to that shown in FIG. 8 but showing the results of trials for a wood-free coated machine.

FIGS. 8 and 9 show graphs 172 and 174, representing results obtained from commercial BEL-CHAMP dryer groups.

Figure 10:
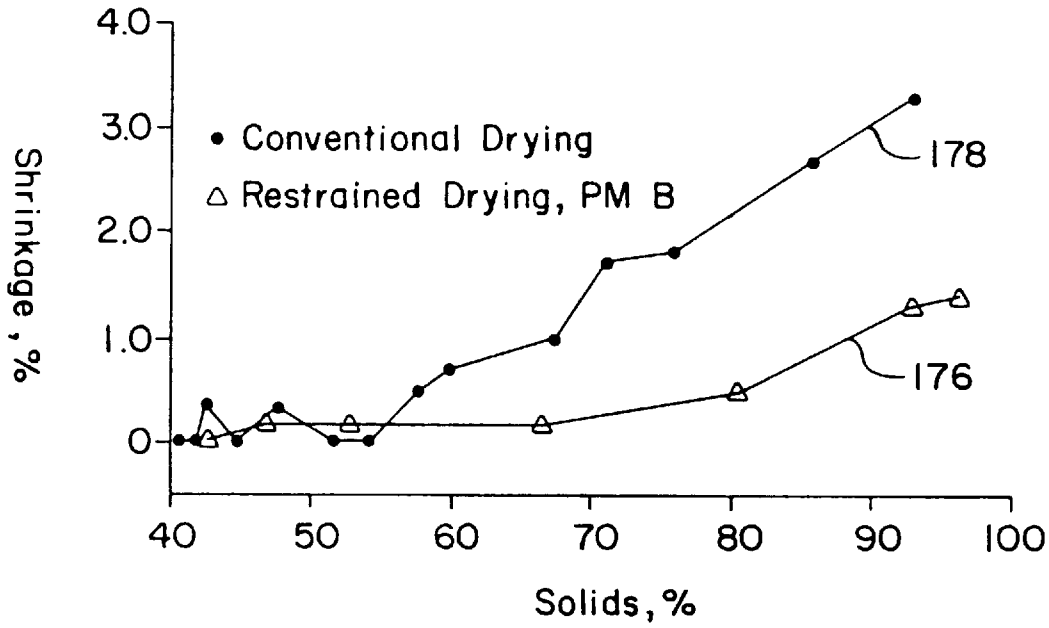
FIG. 10 is a graph comparing results obtained from a BEL-CHAMP dryer group and a conventional double felted dryer group, indicating that the amount of cross-machine directional shrinkage in the BEL-CHAMP arrangement remains approximately zero (0) until the web is at least 65 percent dry.

FIG. 10 shows two graphs. The first graph, 176, shows results from a BEL-CHAMP dryer group demonstrating that the cross-machine directional shrinkage remains substantially zero (0) until the web reaches a dryness of approximately 65 percent dry.

The other graph, 178, shows the results taken from trials conducted using a conventional two tier, double felted drying arrangement. In this instance, the cross-machine directional shrinkage rapidly increases as the web attains approximately 55 percent solids, meaning that the web is 55 percent dry.

The present embodiment provides the advantages of an all top felted dryer cylinder arrangement, therefore avoiding the problem of broke removal associated with bottom felted, single tier groups.

A two tier group is used at the dry end, and all the transfers are accomplished on the operating floor level. Also, all of the transfers between dryer groups are preferably closed draws until the web enters the two tier, double felted group.

The two tier group is utilized only after the web has attained a dryness at which the effects of the single tier arrangement become less favorable. This dryness level may alternately be over about 80%, over about 75%, or over about 70% dryness.

Although specific minimal dryness levels have been specified, it will be appreciated by those skilled in the art that different grades of paper tend to curl at different dryness levels.

Alternately, according to the present invention, the two tier dryer group can be located so the web reaches this group when the web has a particular critical moisture content. At the critical moisture content, the sheet has sufficient strength to be transferred through open draws, the machine direction draws required to maintain good runnability are low, and cross-machine directional shrinkage would begin to occur, even in an alternating single tier dryer group. The critical moisture content is contemplated to be an alternate indication of the optimal point for transferring the web from the single tier top-felted dryer group to the double tier group for controlling latent curl.

The aforementioned critical moisture content is not a fixed value of, for example, 70 percent dry. The value will depend on various properties of the pulp from which the sheet is being made, the sheet processing conditions, and the properties of the finished sheet. These properties are believed to include the resultant sheet wet and dry strengths, the degree of shrinkage, and the point at which unrestrained cross-machine directional shrinkage begins.

For purposes of the present invention, however, the sheet moisture content, which must be reached before the single tier dryer group can end and the two tier group can be used, is based on the water retention value (WRV) of the pulp. Pulps with higher WRVs will begin to shrink at a much lower web dryness than pulps with lower WRVs, and a shrinkage will be of a larger magnitude.

The critical moisture content for unrestrained webs has been measured and reported in "Effect of Water Retention Value (WRV) on the Paper Web Drying Process" by K. Przybysz and J. Czechowski in Cellulose Chem. Technology, Volume 20, Pages 451–464, published in 1986 (Przybysz, et al.).

The equation for the critical moisture (paper dryness) M given by Przybysz et al. is:

$$M=81-0.246(WRV)$$

In the formula, WRV is the water retention value expressed in percentage, measured according to the Zell Chemung standard and M is the critical moisture content at which shrinkage begins, expressed in percent dryness. However, the "81" in this formula assumes unrestrained drying. The critical sheet dryness for a partially or fully restrained web will be higher, so the sheet dryness for the preferred dryer containing a series of single tier dryer groups should also be higher. For restrained drying, the present inventors have estimated that the critical moisture content is very approximately 20 percentage points higher than the unrestrained shrinkage point.

Such restraint may be achieved, for example, by employing at the wet end of the machine single tier drying sections which apply vacuum levels from their vacuum rolls of at least about six inches (water column) (about 1500 Pa) of vacuum, alternatively at least about eight inches (water column) (about 2000 Pa) of vacuum, alternatively at least about ten inches (water column) (about 2500 Pa) of vacuum. These vacuum levels are measured in the conventional manner, such as by tapping a gauge or sensor into the conduit which connects a source of vacuum to the interior of each vacuum roll.

Consequently, the inventors contemplate that the critical moisture content (paper dryness) for transferring the web from a series of top-felted single tier dryers to a two tier group might be ascertained from the equation:

$$M=101-0.246\ (WRV)$$

In the illustrated embodiment of the present invention, the dryer cylinders and the group-to-group transfers (including the press-to-dryer group transfer, the dryer group to dryer group transfers, and the dryer-to-calender transfer) are located for direct access from the main operating floor.

In this embodiment of the present invention, five single tier top felted groups are provided, each including six dryer cylinders. However, the groups can include more or fewer dryer cylinders—as few as two and as many as nine or more, for example. More or less dryer groups can also be provided.

The dryer cylinders can extend generally horizontally, and can be located above the operating floor at a height which makes them all directly accessible by the machine operators from the operating floor.

The dryer hood, which is not shown in FIG. 4, remains below the height of the press group. The ability to accommodate a low hood is still another advantage of the single tier dryer groups illustrated here.

A series of top felted groups shown in FIG. 4 is followed by at least one two tier dryer group which can be operated to control curl at the very end of the dryer. Some curl control is effected even if the upper and lower dryer cylinders are operated at the same steam pressures, thus equally drying the upper and lower sides of the web in the two-tier section. A higher degree of control is preferably maintained by fine-tuning the steam pressures in the top and bottom dryer cylinders so some or all of the lower cylinders receive more steam pressure than some or all of the upper cylinders. This preferentially dries the top of the web to counteract the preferential drying of the bottom of the web in the top-felted single tier groups.

The two tier group also increases the number of dryer cylinders that can be located in the available building length. The last dryer group also provides an open draw where a tail cutter can be installed.

In one embodiment of the present invention, the transfer between the last single tier group and the two tier group is accomplished using two vacuum rolls and a joint run of the two fabrics or felts to allow a stable transfer of the web.

In the two tier dryer group, each felt roll is located in an offset position relative to the center line between adjacent dryer cylinders, with the felt rolls being offset towards the wet end of the machine. The offset is adjusted so that the felt roll surfaces near the tangent point of the web run from one dryer cylinder to the next. Intermediate felt rolls could be plain rolls used in combination with ventilating blow boxes, PV rolls, or preferably BELVENT rolls. ("BELVENT" is a trademark of Beloit Corporation.) BELVENT rolls have two internal chambers, one for directing ventilation air into the dryer pocket, and the other for exhausting humid air from the dryer pockets. BELVENT rolls can be used to ventilate the dryer pockets, thereby keeping the pockets in flow balance and thereby stabilizing the transfer of the wet web.

The present invention also includes the method of passing the web through more than one dryer group for drying the web until the web is at least about 70 percent dry, each of the dryer groups being a top felted, single tier dryer group for facilitating downward removal of broke; and subsequently drying both sides of the web in order to inhibit curl in the resultant web. The web may instead be dried to more than about 70% dryness, or to more than about 75% dryness or to more than about 80% dryness, or from about 75% dryness to about 80% dryness, just before drying both sides of the web.

It will be understood by those skilled in the art that the step of inhibiting or reducing the degree of curl, and the apparatus for carrying out that step, can take many different forms. The fundamental principle is to equalize or correct a large degree of one-sided drying of the first side of the web in the wet end by equally drying both sides or preferentially drying the second side of the web after the appropriate dryness level is reached (at least momentarily).

Broadly speaking, many kinds of apparatus directly or remotely following the first or one-sided drying portion of a dryer can be used to inhibit curl.

In the embodiment illustrated previously, the apparatus to inhibit curl is web drying apparatus, such as apparatus capable of preferentially drying the second side of the web. As in the illustrated embodiment, the web drying apparatus can be at least one heating device capable of heating the web. One example of a heating device is the illustrated steam heating device, which can be at least one steam heated dryer cylinder or at least one single tier or two tier dryer group which includes more than one such dryer cylinder, or two or more groups, respectively of top-felted and bottom-felted drying cylinders.

Alternative apparatus other than, or in addition to, dryer groups can also be used to control curl according to the present invention. The paper making machine can include apparatus directly or remotely following the first, preferentially-drying portion of a dryer for completing drying, heating, calendering, sizing, coating, rewetting, and carrying out other functions on the originally wet or re-wetted paper web which will inhibit curl if carried out in a certain manner.

Figure 11:
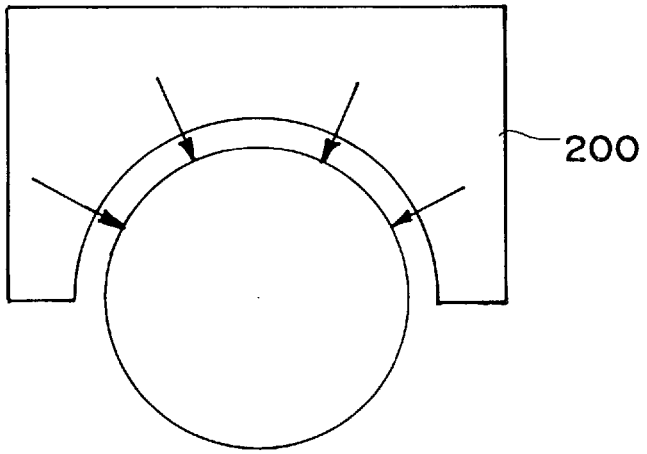
FIG. 11 is a schematic drawing of an air impingement heater.

One example of a curl control device is a web heater, particularly a web heater which preferentially heats the second side of the web after the first side is preferentially dried to a high level of dryness. The apparatus can include a wide variety of heating devices in any suitable number (i.e. one or more). Air impingement heaters 200 as shown in FIG. 11 can be used to heat the second side of the web. Radiant heaters such as heat lamps, electrical induction heating, fuel combustion heaters can be used to dry the web and control curl at the same time.

At least one calendar roll, for example a heated calender roll, or more particularly a heated, soft nip calender roll can be used to calender and control curl at the same time.

Fluid can be applied to the web after it is partially dried to inhibit curl. The fluid can include water, steam, coating compositions, size, or other fluids. Fluids can be used to relax or rewet the web on one or both sides (for example, the preferentially-dried side) to control curl, to directly heat the web to control curl, and can be applied in such a way as to reduce the dryness of the web below 70% or "M," even after the web has previously been dried to a point greater than 70% dryness or "M".

The wetting device can be capable of preferentially wetting one side of the web. Useful wetting apparatus includes a coating device capable of coating the web, a size press or other sizing apparatus, etc.

Another category of curl controlling apparatus contemplated here is apparatus for mechanically bending the web. (Curl can be loosely compared to scoring a ribbon with a scissors blade to curl it, in which case the contemplated curl control apparatus can be analogous to scoring the other side of a curled ribbon to uncurl it.) The apparatus for mechanically bending the web can be a roller, typically of small diameter, about which the web can be wrapped. The roller can be positioned to receive the second side of the wrapped web.

The curl control apparatus can be any other manner of treating device capable of preferentially treating one side of the web. The treating device can be a ventilating device which preferentially ventilates one side of the web to increase its dryness relative to the other side of the web.

The present invention particularly relates to the direct effect of extending single-sided drying on the curl behavior of the web. More specifically, curl control should be started soon enough to avoid curl in the finished sheet.

While not intending to be bound by the accuracy or completeness of any theory respecting how the invention works, the inventors contemplate that he invention works as it does for the following reasons.

The inventors have now recognized that curl control is most effective at the end of the dryer group, usually where the final dryness is being achieved after the web has been dried to at least 70% solids or "M."

Additionally, the inventors appreciate that some evaporation occurs from the side of the web opposite to the side that contacts the dryer cylinder. Air drying can be particularly significant for lightweight paper grades, like newsprint, fine paper and lightweight coated paper (LWC). Air drying of the non-contacting side of the web reduces the degree to which the other, dryer-contacting side of the web is preferentially dried.

The inventors also recognize that the early dryer cylinders-primarily preheat the web while its heat transfer rate is high, and thus neither dry it very much nor heat it unequally. Further, the early dryer cylinders often use lower steam pressures in the cylinders to avoid picking.

Based on the aforementioned factors, the inventors now recognize that the web may contact a substantial number of dryer cylinders on one side first, before alternate-side drying is required to maintain low curl.

Furthermore, the inventors have discovered that one-sided drying can be continued even longer than what might be suggested from the aforementioned factors alone. This is because curl control is most effective at the end of the dryer group. Very little curl-inducing shrinkage of either the individual fibers or the fiber networks occurs at the wet end of the dryer group. The majority of the shrinkage forces are developed after the web has reached a low moisture content. As a result, the web can be dried through most of the dryer from one side only, without creating a problem with sheet curl.

Because of the complexities associated with shrinkage and the drying process, and the furnish factors, it is difficult to accurately predict the critical moisture content. The critical moisture content will be different for different grades and furnishes.

Another alternative approach to determining the critical moisture content is to measure the effect of single-sided drying directly in the laboratory for the desired furnish. This experiment was performed using a 64 grams per square meter (64 gsm) sheet made on a pilot paper machine. The sheets were dried from one side for a specific number of drying cycles before reversing the side of drying. Sheet curl was measured at the end of the drying process.

Significant curl was seen as the single-sided drying extended to above a point between 65% and 80% dryness.

Due to the number of variables that can influence the critical moisture (furnish, drying rate, basis weight, etc), the critical moisture has been recognized by the inventors to be at least 65 percent dry, with the presently preferred range being between 70 and 85 percent dry.

What is claimed is:

1. A paper making machine comprising:

A. a section for forming a wet paper web having first and second sides; and

B. at least a first portion of a dryer which is configured for preferentially drying the first side of the wet paper web to a dryness level of at least about 70% solids.

2. The paper making machine of claim 1, further comprising apparatus following said first portion of a dryer to inhibit curl.

3. The paper making machine of claim 2, wherein said apparatus to inhibit curl is web drying apparatus.

4. The paper making machine of claim 3, wherein said web drying apparatus is capable of preferentially drying the second side of the web.

5. The machine of claim 4, wherein said web drying apparatus comprises at least one heating device capable of heating the web.

6. The machine of claim 5, wherein said heating device comprises a device for transferring heat from steam to the web.

7. The machine of claim 6, wherein said device for transferring heat from steam to the web comprises at least one steam heated dryer cylinder.

8. The machine of claim 7, further comprising a felt wrapped about a portion of said dryer cylinder for urging the second side of the web into contact with said heated dryer cylinder.

9. The machine of claim 5, wherein said heating device comprises at least one air impingement heater.

10. The machine of claim 2, wherein said first portion of a dryer is a plurality of single tier dryer groups.

11. The machine of claim 10, wherein said plurality of single tier dryer groups is top-felted.

12. The paper making machine of claim 2, including apparatus following said first portion of a dryer for completing the drying of the wet paper web.

13. A paper making machine comprising:

A. a section for forming a wet paper web having first and second sides; and

B. at least a first portion of a dryer which is configured for preferentially drying the first side of the wet paper web to a dryness level of at least about M, as represented by the formula:

$$M=101-0.246\ (WRV)$$

in which M equals dryness of the web (critical moisture content) and WRV equals water retention value of the web, measured in percentage.

14. The paper making machine of claim 13, further comprising apparatus following said first portion of a dryer to inhibit curl.

15. The paper making machine of claim 14, wherein said apparatus to inhibit curl is web drying apparatus.

16. The paper making machine of claim 15, wherein said web drying apparatus is capable of preferentially drying the second side of the web.

17. The machine of claim 16, wherein said web drying apparatus comprises at least one heating device capable of heating the web.

18. The machine of claim 17, wherein said heating device comprises a device for transferring heat from steam to the web.

19. The machine of claim 18, wherein said device for transferring heat from steam to the web comprises at least one steam heated dryer cylinder.

20. The machine of claim 19, further comprising a felt wrapped about a portion of said dryer cylinder for urging the second side of the web into contact with said heated dryer cylinder.

21. The machine of claim 17, wherein said heating device comprises at least one air impingement heater.

22. The machine of claim 14, wherein said first portion of a dryer is a plurality of single tier dryer groups.

23. The machine of claim 22, wherein said plurality of single tier dryer groups is top-felted.

24. The paper making machine of claim 14, including apparatus following said first portion of a dryer for completing the drying of the wet paper web.

25. A method for drying a web of paper, comprising the steps of:

A. forming a wet paper web having first and second sides; and

B. preferentially drying the first side of the wet paper web to a dryness level of at least about 70% solids.

26. The method of claim 25, further comprising the step of acting on the web after said preferentially drying step to inhibit curl.

27. The method of claim 26, wherein said acting step is carried out by drying the web.

28. The method of claim 26, wherein said acting step is carried out by preferentially drying the second side of the web.

29. The method of claim 26, wherein said acting step is carried out by preferentially heating the second side of the web.

30. The method of claim 26, wherein said acting step is carried out by urging the second side of the web into contact with at least one heated dryer cylinder.

31. The method of claim 26, including the step, following said preferentially drying step, of completing the drying of the wet paper web.

32. A method for drying a web of paper, comprising the steps of:

A. forming a wet paper web having first and second sides; and

B. preferentially drying the first side of the wet paper web to a dryness level of at least about M, as represented by the formula:

$$M=101-0.246\ (WRV)$$

in which M equals dryness of the web (critical moisture content) and WRV equals water retention value of the web, measured in percentage.

33. The method of claim 32, further comprising the step of acting on the web after said preferentially drying step to inhibit curl.

34. The method of claim 33, wherein said acting step is carried out by drying the web.

35. The method of claim 33, wherein said acting step is carried out by preferentially drying the second side of the web.

36. The method of claim 33, wherein said acting step is carried out by preferentially heating the second side of the web.

37. The method of claim 33, wherein said acting step is carried out by urging the second side of the web into contact with at least one heated cylinder.

38. The method of claim 32, including the step, following said preferentially drying step, of completing the drying of the wet paper web.

39. A drying apparatus for drying a web of paper, said apparatus comprising:

a plurality of drying groups for drying the web;

each of said drying groups including:

a plurality of dryers disposed in a single tier configuration;

a plurality of vacuum transfer rolls, each vacuum roll being disposed between adjacent dryers of said plurality of dryers;

a dryer felt extending alternately around each dryer and each vacuum roll, the arrangement being such that each of said dryers is top felted so that broke removal is facilitated, each of said drying groups being arranged in succession;

a further single drying group only disposed downstream relative to said plurality of drying groups such that the web extends between said plurality of drying groups and said further drying group;

said further drying group including:

an upper tier of dryers;

an upper plurality of rolls disposed between adjacent dryers of said upper tier;

an upper felt extending alternately around each dryer of said upper tier and each roll of said upper plurality of rolls;

a lower tier of dryers;

a lower plurality of rolls disposed between adjacent dryers of said lower tier;

a lower felt extending alternately around each dryer of said lower tier and each roll of said lower rolls, the arrangement being such that the web extends in open draw between each dryer of said upper and lower tiers so that any tendency of the web to curl is controlled during movement of the web through said further drying group; and the web extending between said plurality of drying groups and said further drying group when the web has attained a dryness of at least M, as represented by the formula:

$$M=101-0.246\ (WRV)$$

in which M equals dryness of the web (critical moisture content) and WRV equals water retention value of the web, measured in percentage.

* * * * *